US008089374B2

(12) United States Patent
Mayer et al.

(10) Patent No.: US 8,089,374 B2
(45) Date of Patent: Jan. 3, 2012

(54) LED SIGNAL LIGHT

(75) Inventors: Mark J. Mayer, Sagamore Hills, OH (US); Eden Dubuc, Saint-Michel (CA)

(73) Assignee: GE Lighting Solutions, LLC, Cleveland, OH (US)

( * ) Notice: Subject to any disclaimer, the term of this patent is extended or adjusted under 35 U.S.C. 154(b) by 637 days.

(21) Appl. No.: 12/273,186

(22) Filed: Nov. 18, 2008

(65) Prior Publication Data

US 2010/0123600 A1 May 20, 2010

(51) Int. Cl.
*G08G 1/095* (2006.01)

(52) U.S. Cl. ..... 340/907; 340/904; 340/435; 340/439; 340/475; 340/630; 362/286; 362/299; 362/328; 362/331; 362/335

(58) Field of Classification Search ..... 340/907, 340/904, 435, 439, 475, 630; 362/286, 299, 362/328, 331, 335
See application file for complete search history.

(56) References Cited

U.S. PATENT DOCUMENTS

| | | | | |
|---|---|---|---|---|
| 4,841,278 | A | 6/1989 | Tezuka et al. | |
| 4,962,450 | A | 10/1990 | Reshetin | |
| 5,353,133 | A * | 10/1994 | Bernkopf | 349/5 |
| 5,580,156 | A | 12/1996 | Suzuki et al. | |
| 6,731,222 | B2 | 5/2004 | Martineau | |
| 6,851,833 | B1 | 2/2005 | Simon | |
| 7,616,299 | B2 * | 11/2009 | Okawa et al. | 356/237.1 |

FOREIGN PATENT DOCUMENTS

| | | |
|---|---|---|
| DE | 1 951 199 A1 | 7/1971 |
| DE | 199 30 584 | 6/2001 |

OTHER PUBLICATIONS

European Search Report dated Oct. 28, 2010.
European Search Report dated Mar. 25, 2010.

* cited by examiner

*Primary Examiner* — Tai T Nguyen
(74) *Attorney, Agent, or Firm* — Fay Sharpe LLP

(57) ABSTRACT

A signal is described that includes one or more LEDs that emit light and a lens that receives and collimates the light from the LED array. A distribution optic receives light from the collimating lens and distributes the light in a predetermined pattern according to a specification. A light absorbing/reflecting element is located in an area proximate the one or more LEDs to minimize light received from an external source from exiting the signal.

22 Claims, 8 Drawing Sheets

LED SIGNAL LIGHT

BACKGROUND

The present invention relates to LED-based lighting systems and, in particular, traffic signals. The exemplary embodiments find particular application in conjunction with minimizing reflection of light received from an outside source, such as the sun. One approach is to utilize one or more retroreflectors to reflect the externally originating light back toward the source. Another approach is to use a lens to direct externally originating light into an aperture within the signal housing.

Automotive, railway, vehicular, waterway, illumination, and/or pedestrian signals are employed to regulate motorists and pedestrians via various commands. These commands are provided by an illumination source with particular colors and/or shapes that are each associated with an instruction. For example, light emitting diodes can illuminate an appropriate signal that indicates a command to motorists and/or pedestrians.

In order to provide a signal that is clearly visible, signals can locate the light elements on a reflective substrate and further use reflectors to direct light emitted from the illumination source. A common problem with traffic signals occurs when external light (e.g., from the sun) enters the front of the signal, is reflected off internal specular surfaces and exits the signal at an angle that reaches a driver's and/or pedestrian's eyes.

The problem can be exacerbated by one or more optical element utilized to direct the light from the illumination source out of the signal. In general, light generated by the illumination source is directed out of the signal via optical elements, such as a lens, a collimator, a diffuser and the like. However, the same components can direct externally originating light into the signal following substantially the same path. In this manner, light that is received from an external source is directed toward the illumination element typically located at the back of the signal. The externally originating light can then be further reflected by the reflective substrate and out the signal on the same path as light generated by the illumination source light. In this manner, it can appear that the signal is on, even when the illumination source is unit.

Accordingly, it would be advantageous to have systems and methods which minimize reflection of light received by a signal from an outside source.

BRIEF DESCRIPTION

In one aspect, a light emitting device includes one or more LEDs that emit light and a lens that receives and collimates the light from the one or more LEDs. A distribution optic receives light from the collimating lens and distributes the light in a predetermined pattern. A light absorbing/reflecting element is located in an area proximate the one or more LEDs to minimize the amount of light received from an external source which exits the signal.

In another aspect, an LED traffic signal includes a rear housing wall and an LED array mounted to the rear housing wall. A lens receives and collimates the light from the LED array and a distribution optic receives light from the lens and distributes the light in a predetermined pattern. A converging element receives external light from the lens and directs it to a predetermined location on the rear housing.

In yet another aspect, an LED traffic signal comprises a housing that includes a rear housing wall. An array of LEDs is mounted to the rear housing wall and a lens receives and collimates the light from the LED array. A distribution optic receives light from the lens and distributes the light in a pattern according to a specification. A plurality of retroreflectors are mounted to the rear housing wall below the LED array to receive external light and minimize sun phantom effect associated with an external light.

DETAILED DESCRIPTION

In describing the various embodiments of the lighting system, like elements of each embodiment are described through the use of the same or similar reference numbers.

Figure 1:
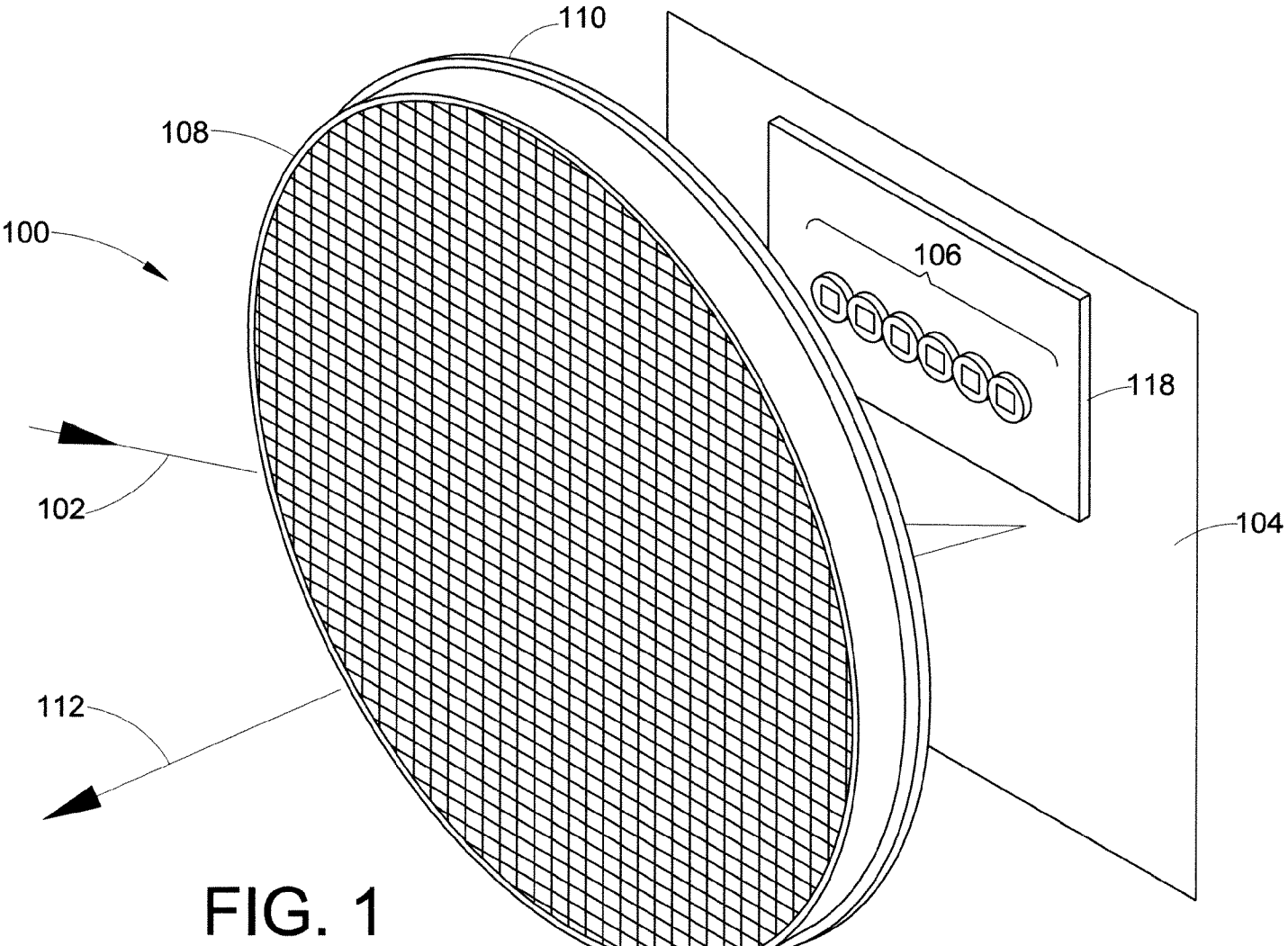
FIG. 1 (PRIOR ART)
FIG. 1 illustrates an exploded isometric view of a prior art LED traffic signal.

FIG. 1 illustrates an exploded view of a traditional LED traffic signal 100. It is noted that while the description herein is of a traditional signal, many features thereof are equally relevant to the present invention. A housing including a rear wall 104 supports an LED array. Not shown is an intervening housing body that joins rear wall 104 and a lens 110. In this manner, the signal can be mechanically coupled together utilizing tabs, snaps, or other joining elements.

An array of LEDs 106 is mounted to a PCB 118 that is coupled to a power supply (not shown) that delivers power to the LED array 106. The PCB 118 is mounted to the wall 104. In this example, the LEDs are configured in a linear array; however it is to be appreciated that substantially any configuration (e.g., circle, square, parallelogram, etc.) can be employed. Alternatively, the LED array 106 could be mounted directly to the wall 104 without an intervening PCB 118. Traditionally, the surface upon which LED array 106 is mounted (PCB or rear housing wall) will provide at least limited light reflection properties.

The rear wall 104 can be made of a thermally conductive material to act as a heat sink for the LED array 106 mounted thereon. Alternatively or in addition the rear wall 104 can include a separate element (not shown) to draw heat away from the LED array 106.

The LED array 106 is energized via a control system (not shown) to produce light to direct pedestrian and/or vehicular traffic. The LED array can include substantially any type of LED devices including, for example, batwing, side-emitter, and/or Lambertian. When active, the LED array 106 transmits light through a lens 110 and a distribution optic 108 and out the front of the LED signal 100. Light emitted from the LED array 106 is received by the lens 110 directly from the LEDs and reflected from the intervening body housing and other surfaces and therefore at a plurality of angles. Lens 110 collimates the light so that it is emitted along substantially the same axis which is typically normal to the surface of the lens 110 from which it exits. Lens 110 can be a Fresnel lens.

Distribution optic 108 and lens 110 are oriented with respect to the LED array 106 to emit light from the signal 100 in a particular pattern. Such orientation can cause the signal 100 to capture and direct various amounts of light emitted from the LED array 106 into one or more areas across the face of the signal 100. Disparate light distribution patterns can be defined by a variety of specifications for traffic signal light emission in conformance with one or more government standards such as those promulgated by the American Association of State Highway and Transportation Officials (AASHTO), the Institute of Transportation Engineers (ITE), the National Electrical Manufacturers Association (NEMA), the European Telecommunications Standards Institute (ETSI), the European Committee for Electrotechnical Standardization (CENELEC), and the European Committee for Standardization (CEN).

In one embodiment, the lens 110 includes a plurality of collimating zones to provide an output that is substantially uniform across the surface of the distribution optic 108. Distribution optic 108 can have a pattern inner or outer surface to selectively distribute light from the lens 110. Similarly, the path can be created by a masking element separate from the distribution optic. Alternatively, or in addition, the distribution optic 108 can be located between the lens 110 and the wall 104 to first pattern the light. In yet another embodiment, the collimation and/or distribution and/or patterning of light can be accomplished via a single optical element.

Figure 6:
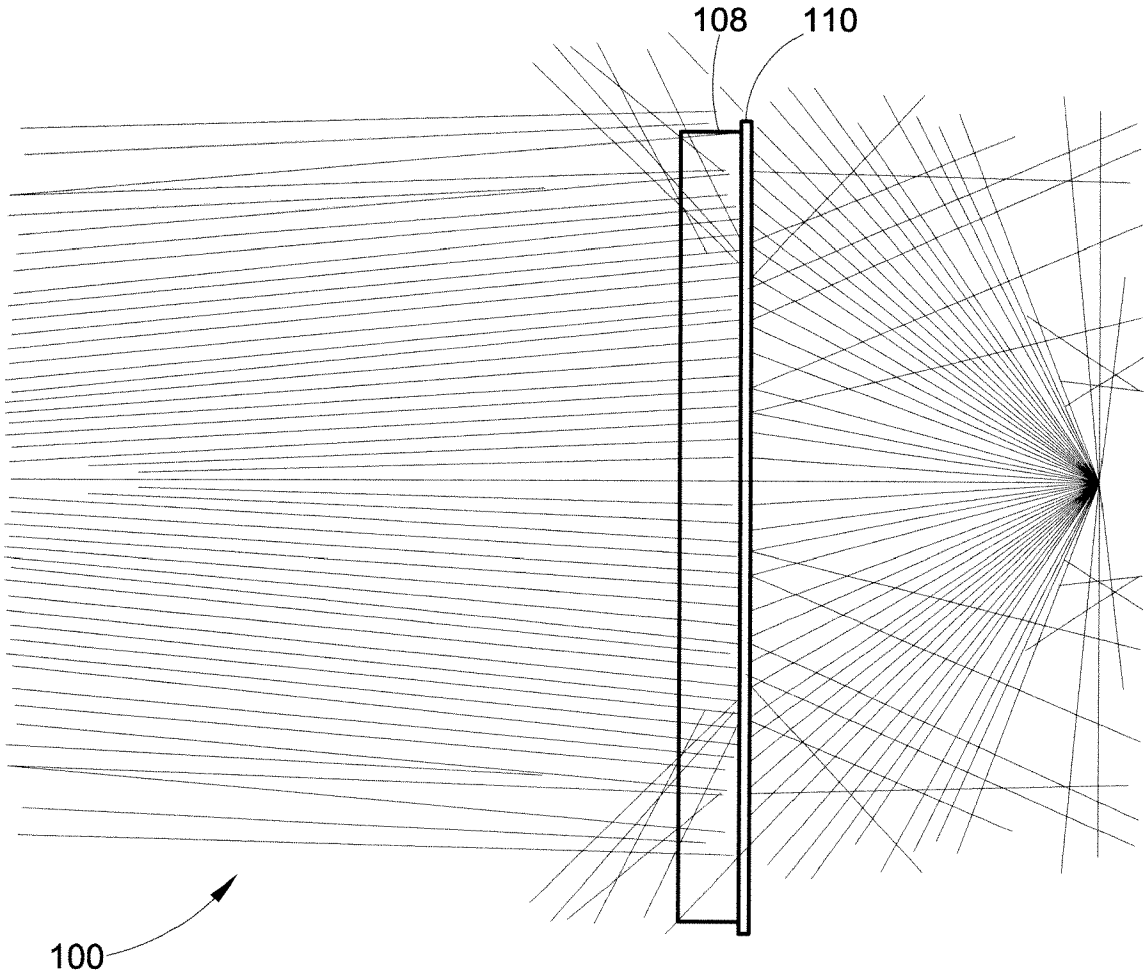
FIG. 6 illustrates a side view of an LED traffic signal with rays to show the path of light travel within the signal, in accordance with an aspect of the subject invention.

With regard to patterning, the outer surface of the distribution optic 108 can direct light out of the signal in a particular direction (e.g., upward, downward, etc.). In one example, light is preferentially transmitted laterally and downward via the distribution optic 108 for European applications. In another example, light is transmitted laterally, upward and downward for U.S. designs as illustrated in FIG. 6. However, the present invention is not limited to any particular light distribution pattern.

While lens 110 is shown having a circular configuration, any shape including square, rectangular (horizontally or vertically elongated), and elliptical are feasible. For example, a railroad application may use a rectangular vertical elongated lens as the required horizontal viewing aspect is very narrow (e.g., generally the width of the train track). A tall vertical aspect allows viewing of the signal from a wide vertical range to correspond to viewing locations near and far from the signal at either track or train cab level. Similarly, an automobile traffic signal may be designed with a rectangular horizontally elongated lens to have a wide spread horizontally, across several lanes of traffic. Ray tracing (e.g., as illustrated in FIG. 6) is employed to calculate specific optical solutions for both the distribution optic 108 and the lens 110. Suitable software for performing ray tracing, such as Optics Lab, OpTaliX, Zemax, etc., is well known in the art. The lens can be made of an acrylic, vinyl, polycarbonate and glass as examples.

Figure 2:
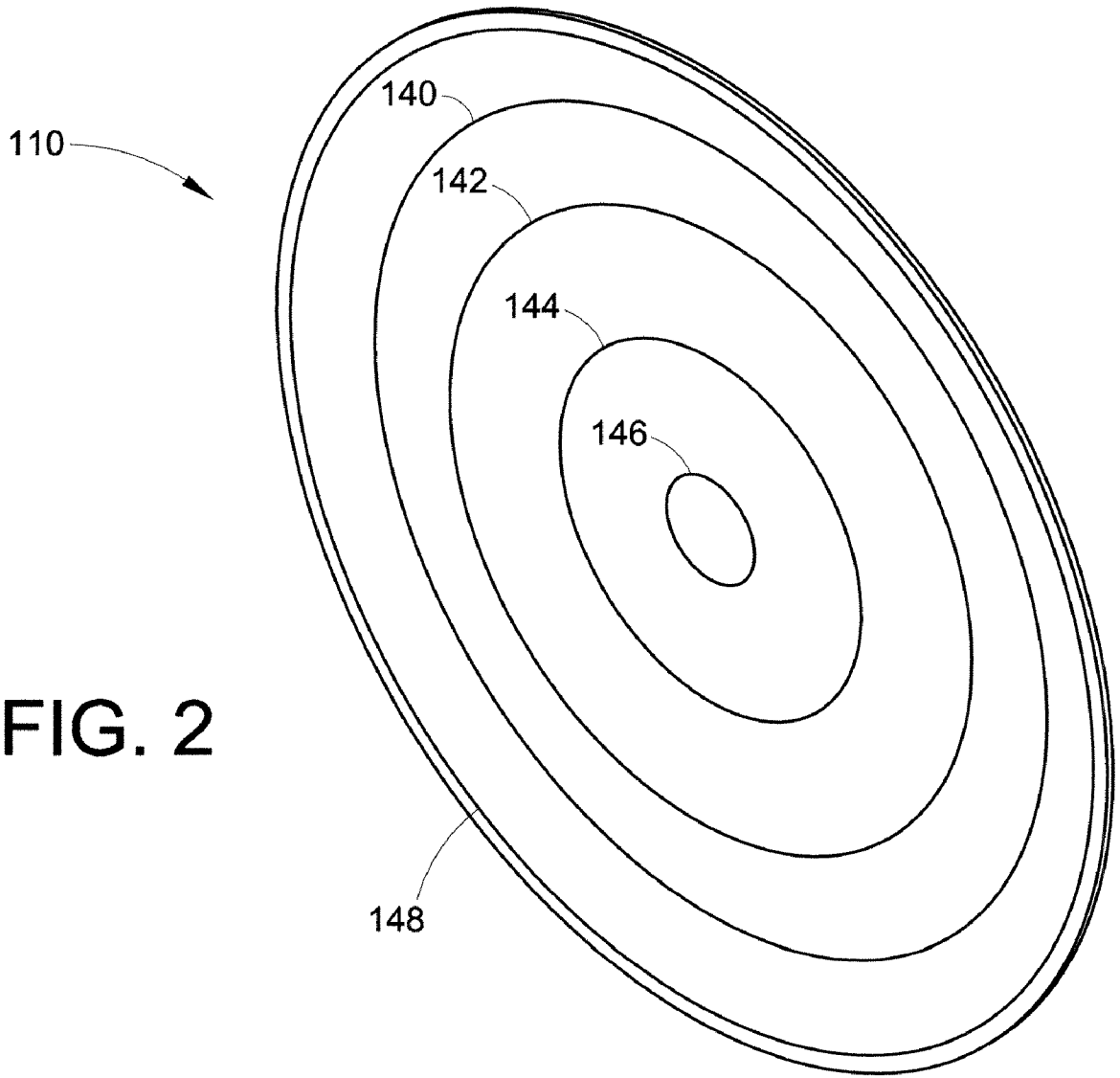
FIG. 2 illustrates an exemplary lens utilized with the LED traffic signal, in accordance with an aspect of the subject invention.

FIG. 2 illustrates a detail view of lens 110 that includes a center portion 146 and an edge portion 148. In this embodiment, lens 110 is a Fresnel lens that collimates light emitted from a source within a short distance. In order to receive and collimate light from disparate angles, lens 110 contains a plurality of concentric rings emanating from the center portion 146 to the edge portion 148. Three of these concentric rings are illustrated as a ring 140, a ring 142, and a ring 144. The surface angle of each section increases as its radial distance increases from the center 146. Thus, the surface angle of the ring 144 is greater than the surface angle of the ring 142. Similarly, the surface angle of the ring 142 is greater than the surface angle of the ring 140. In this manner, light is collimated such that light from a source on one side exits the lens 110 in a parallel fashion on the other side.

Lens 110 includes a plurality of collimating zones that can be circular or linear. Each collimating zone collimates light emanating from its respective LED ring or linear row. The LED light patterns can slightly overlap within and between the rings and rows to prevent the appearance of shadows, lines and/or rings. Due to the overlap, individual LED 106 failure, or variation in LED 106 output between adjacent LEDs 106 will not be discernable by the viewer.

Referring again to FIG. 1, It is known that light received by the signal 100 from an external source (e.g., the sun) can create the appearance that the signal 100 is illuminated when in fact it is not. Light from an external source 102 can enter the LED signal 100 via the distribution optic 108 and is focused by the lens 110 onto the rear wall 104. Light directed at the rear of the housing can reflect off substantially any surface contained thereon whether such surface is specular or diffuse. Such reflection can occur regardless of color of the surface upon which the light hits.

Once the light has reflected off the rear wall 104, the lens 110 collimates the light and the diffuser 108 diffuses the light as it exits the LED signal 100 along an optical path 112. It is to be appreciated that the optical path 112 and the optical path 102 are for illustrative purposes only and that a plurality of incoming and outgoing optical paths can exist. However, the illustration demonstrates that external light on optical path 102 can be reflected out of the signal on optical path 112 resulting in a potential phantom on light to an observer of the signal.

Figure 3:
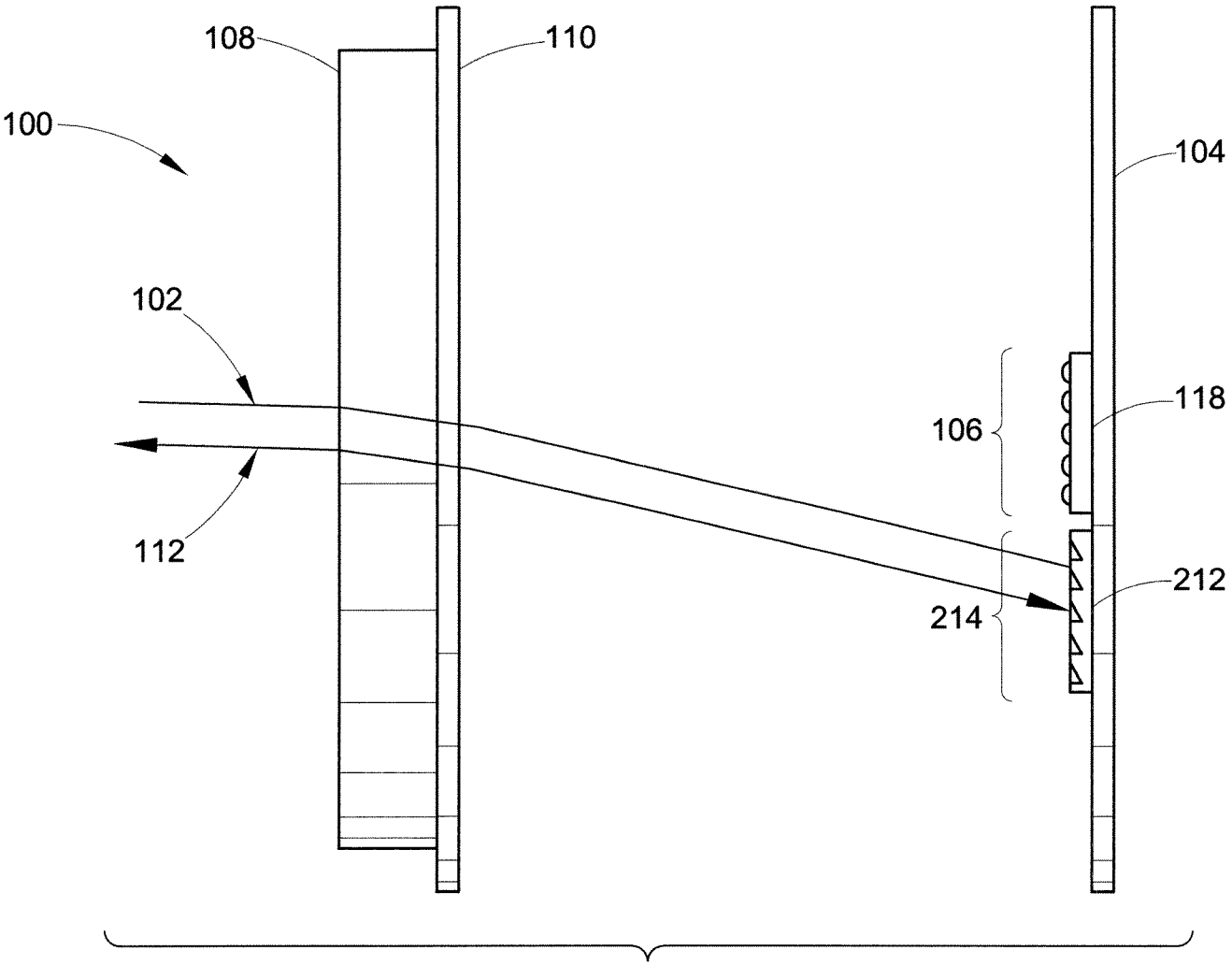
FIG. 3 illustrates a side view of an LED traffic signal with an array of light absorbing/reflecting elements, in accordance with an aspect of the subject invention.

FIG. 3 illustrates the LED signal 100, such as the type described in FIG. 1, but further including an array of light absorbing/reflecting elements 214 placed in an area 212 beneath the LED array 106. The area 212 can be located anywhere within the signal 100 and is primarily dependent on the orientation and configuration of the distribution optic 108 and the lens 110. Moreover, area 212 is preferably located where distribution optic 108 and lens 110 direct external light within the signal 100.

In one embodiment, light received from an external source 102 is refracted/redirected by the diffuser 108 and the lens 110 102 in a downward direction. In this manner, external light 102 is directed to area 212 that is located just below the LED array 106. By placing the light absorbing/reflecting elements 214 in one or more locations where the external light 102 is directed, external light reflected out of the signal 100 can be minimized.

It is to be appreciated that the light absorbing/reflecting elements 214 can have one of reflection and absorption properties. In the reflection function, each light absorbing/reflecting element 214 utilizes a retroreflector (e.g., corner cube) geometry to reflect received light along a path that is substantially parallel to the received light but in the opposite direction. This particular characteristic occurs since the three surfaces, upon which the received light is reflected, are configured normally to one another. In this fashion, the reflected light is directed back in the same direction as its source and is not directed to the eyes of one observing the signal. In the absorption function, the elements 214 can be made of a material that is a dark color (e.g., black) to absorb received light. The material can also have particular properties (e.g., structure, density, etc.) to promote light absorption. For example, a black felt material could be particularly effective.

The number, configuration, and location of the light absorbing/reflecting elements 214 can be selected based on a number of factors such as the path of the external light 102, the number, configuration, and placement of the LED array 106, the diameter of the signal 100, the orientation of the lens 110 and the distribution optic 108, etc. Such optical properties are known to the skilled artisan and based on the teachings herein will allow a suitable number and location of absorbing/reflecting elements to be included in the housing.

The light absorbing/reflecting elements 214 reduce a sun phantom effect of a signal. Sun phantom is generally defined as the amount of external light reflected out of a signal. Sun phantom class is measured as a ratio of light output when a signal is on divided by light output when sunlight is striking the lens at 10 degrees to normal. An advantage of the present invention is that the reduction of sun phantom enhances design options such as reducing cost by utilizing fewer LEDs to meet the same sun phantom class. Alternatively, the same number of LEDs can be employed and an improved sun phantom rating achieved. A third advantage is that with a lower sun phantom, less power is required to illuminate the signal 100 to provide a desired light output.

In a preferred embodiment, the light absorbing/reflecting elements 214 are retro-reflected made from a specular material. The elements 214 have a shape of cube corners that are trimmed, for example, to one of 3, 4, or 6 sided polygons. The elements 214 are arranged in an array such that each of the elements 214 is in contact with one or more disparate elements 214 to eliminate gaps therebetween. Hexagonal, square, triangular shapes may be employed to optimize packing efficiency. In this embodiment, the orientation of each element 214 is identical to one another. However, such orientation is not critical since it is only a goal to redirect light along the same axis in which it is received. The nature of corner reflectors, such as the light absorbing/reflecting elements 214 will accomplish such reflection regardless of the axis of received light.

Each element 214 is typically from 0.0625" to 0.25" in size. Preferably, the width of the array of elements 214 is slightly larger than the width of LED array 106. However, for functional purposes, there is no size restriction as long as the elements 214 can fit within the signal 100 and do not block light emitted from the LED array 106.

The elements 214 can be made of injection molded material in conformance with standard manufacturing methods. Injection molding is a common and cost effective way to manufacture cube corner retroreflectors such as the elements 214. However, any material that is opaque and/or specular can be employed (e.g., metal, glass, granite, etc.).

In the light reflecting embodiment, the light absorbing/reflecting elements 214 preferably direct the external light 102 along a path 112 that is the same or parallel to the external light 102 and out of the signal 100. In this manner, incoming light 102 is reflected directly back to the source (e.g., sun) and thus is not returned (or viewed) to one or more pedestrians or motorists. Since the reflected light cannot be viewed, it will not appear that the signal is illuminated when in fact it is not.

Figure 4:
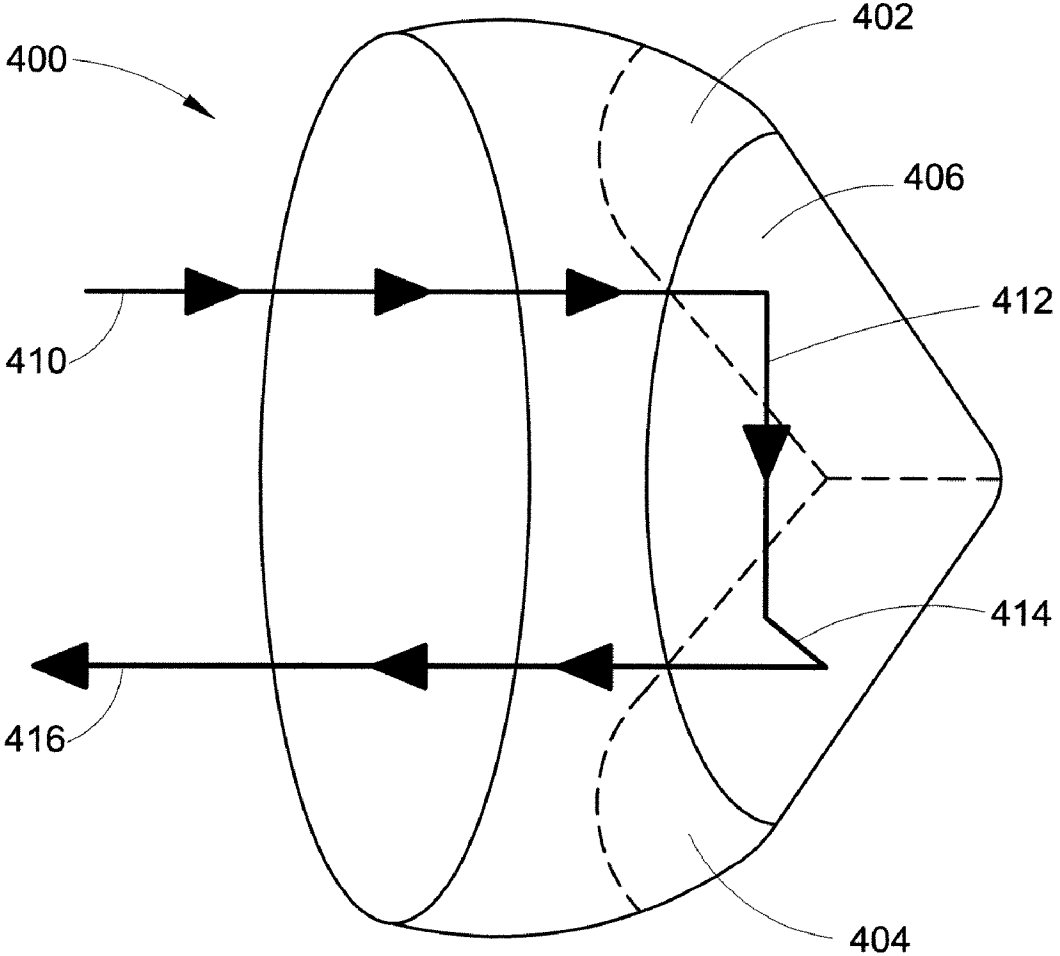
FIG. 4 illustrates a retroreflector, in accordance with an aspect of the subject invention.

As shown in FIG. 4, the light absorbing/reflecting elements 214 are shown as a corner cube retroreflector 400. The retroreflector reflects a wave front back along a vector that is parallel to, but opposite in direction from the angle of incidence. The retroreflector 400 includes a first surface 402, a second surface 404, and a third surface 406 which are mutually perpendicular to each other in three disparate axes. In this embodiment, each of the perimeter of the surfaces 402, 404, and 406 are relatively square to one another and flat. It is to be appreciated, however, that the perimeter of surfaces 402, 404, and 406 can be substantially any shape (e.g., elliptical, oval, parallelogram, etc.). The ray path of the external light intersecting one of the surfaces 402, 404, or 406 is irrelevant since they are mutually perpendicular to one another.

To illustrate the principle, light is received by the retroreflector 400 along path 410 by the first surface 402. The light is reflected off the first surface 402 to the second surface 404 along path 412 that is substantially normal to the path 410. The light is reflected from the second surface 404 to the third surface 406 via a path 414 that is substantially normal to the path 412. The light is reflected by the third surface 406 in a path 416 that is substantially parallel to the path 410 in the opposite direction.

The light absorbing/reflecting elements 214 can be oriented in a position that corresponds with the orientation and configuration of the distribution optic 108 and the lens 110 and/or the incoming path of external light. Such orientation is not critical as long as light is received on any one of the surfaces 402, 404, and 406 since light received is returned along the same axis in the opposite direction. In one example, the signal 100 is mounted to a fixed structure, such as a post, wherein light redirection is desired above the center line of the signal 100. Thus, the light absorbing/reflecting elements 214 would be angled slightly above horizontal in anticipation of the external light location.

Figure 5:
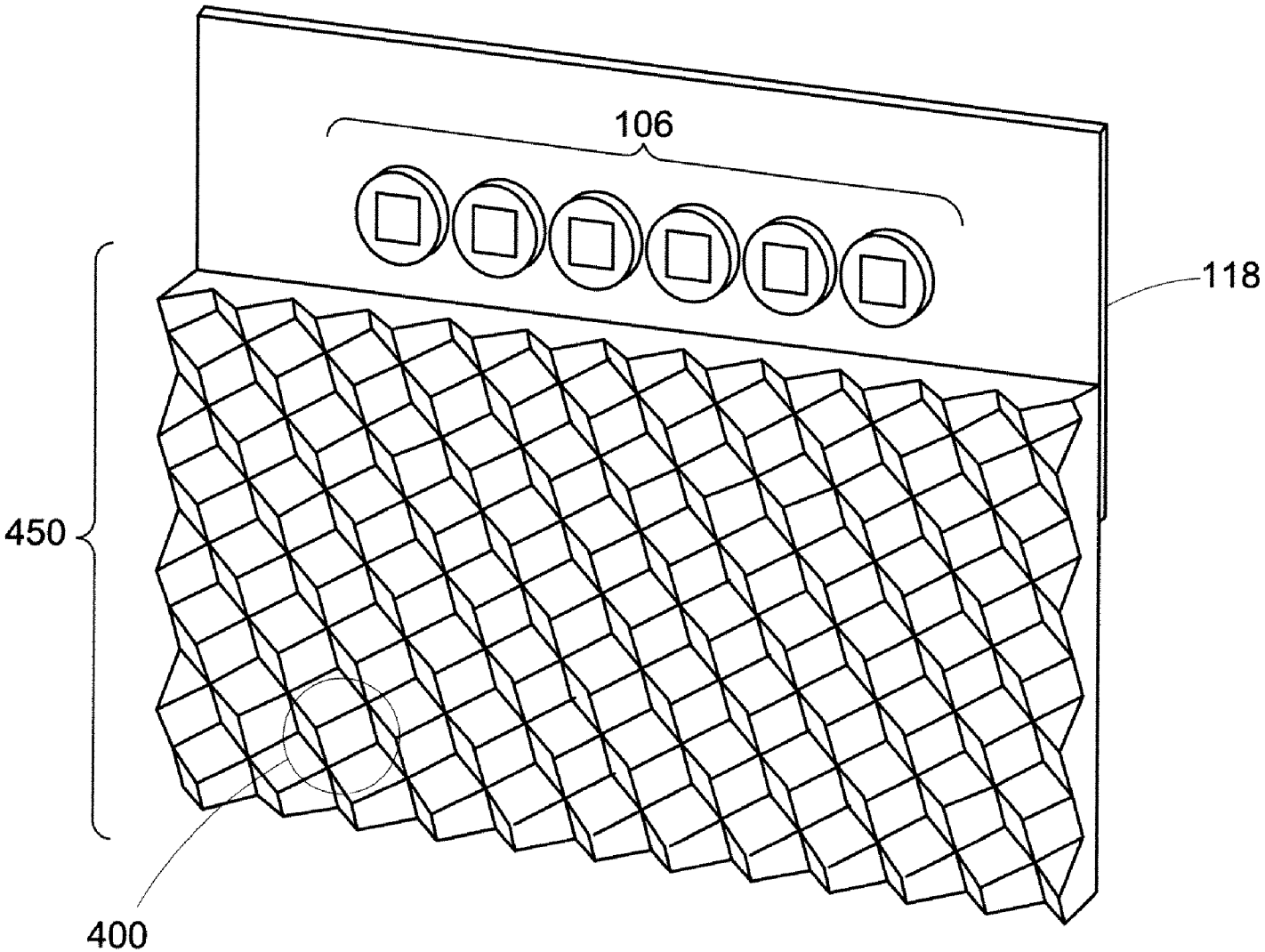
FIG. 5 illustrates LEDs with an array of retroreflector elements, in accordance with an aspect of the subject invention.

FIG. 5 illustrates an array 450 of light absorbing/reflecting elements 214. In this embodiment, each of the elements 214 is a retroreflector 400, one of which is designated within the array 450. The LED array 106 is coupled to the PCB 118. The retroreflectors 400 are placed side-by-side to insure that light received substantially anywhere within the array 450 is reflected back along the same axis in the opposite direction.

Figure 7:
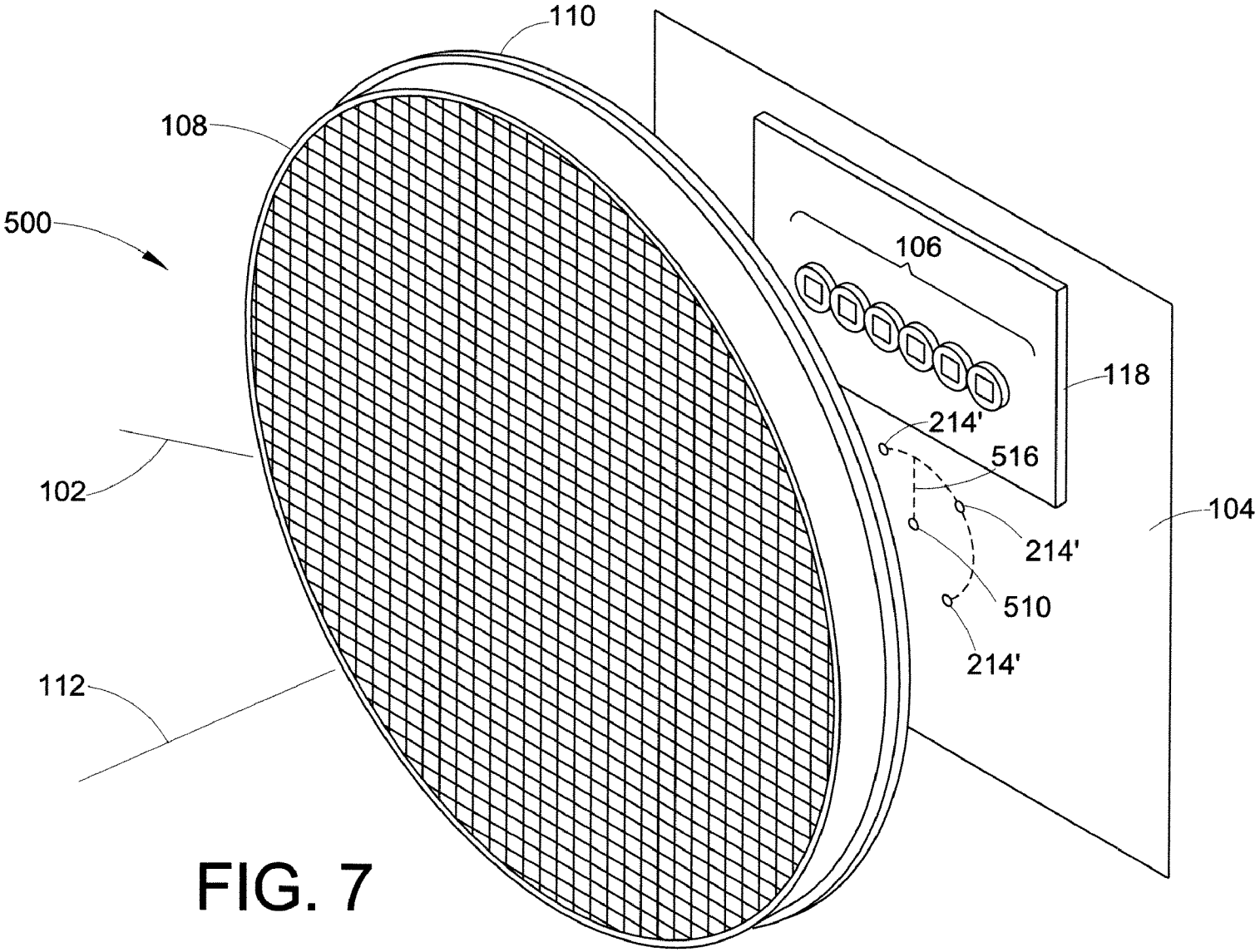
FIG. 7 illustrates an exploded isometric view of an LED traffic signal with a light absorption element, in accordance with an aspect of the subject invention.

In an alternative embodiment, FIG. 7 illustrates a signal 500 that includes a plurality of elements 214' designed to redirect incoming external light into a particular location within the signal 500. In one example, the location is a hole 510 in the back wall of the housing that is employed to trap the external light so that it escape back out of the signal 500. In one embodiment, the hole 510 can be surrounded by a light absorbing material (not shown) to further decrease the amount of external light reflected.

In the signal 500, the elements 214' are mirrors (or equivalent) that are capable of directing received light via reflectance. The elements 214' can be positioned and/or oriented in substantially any location within the signal 500. In one example, the elements 214' are positioned along a circumference of a circle defined by a radius 516 to circumscribe the hole 510. The radius 516 can be determined based on optical properties of the signal 500. This includes the size, orientation, location and type of distribution optic 108 and the lens 110. When light is received at or within the circumference defined by radius 516, it is reflected by one or more of the elements 214' toward the hole 510. The distribution optic 108 and the lens 110 can direct external light into a particular area, as described above that correlates to the radius 516 regardless of the angle/direction of external light into the signal 500.

Figure 8:
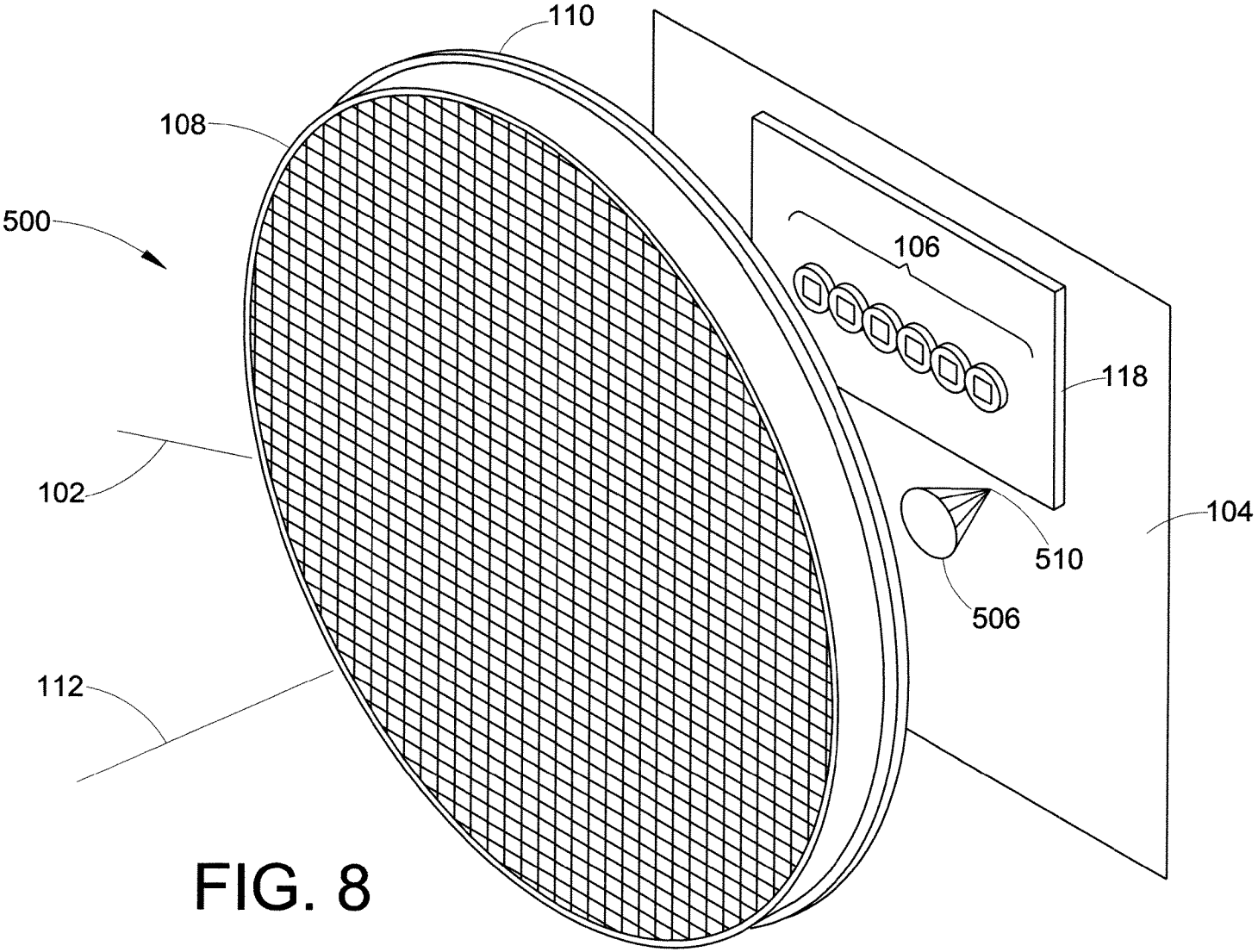
FIG. 8 illustrates an exploded isometric view of an LED traffic signal with a light absorption element, in accordance with an aspect of the subject invention.

In yet another embodiment, FIG. 8 shows a signal 600 that includes a converging element 506 that is positioned between the lens 110 and the rear housing wall 104. The converging element 506 is employed to direct light incident upon it to a particular location via convergence. In one example, the converging element 506 is a positive lens such as a biconvex, a plano-convex, or a positive meniscus type.

In one embodiment, the converging element 506 is employed with the light absorbing/reflecting elements 214 and/or the elements 214'. The size, location, and orientation of the converging element can be based at least in part upon one or more of the size of signal 100, the lens 110 type, size, orientation and placement, the distribution optic 108 type, size, orientation and placement, and the distance from the lens 110 to the LED array 106, as described above.

The invention has been described with reference to the exemplary embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A light emitting device comprising:
one or more LEDs;
a lens that receives and collimates a light from the one or more LEDs;
a distribution optic that receives light from the collimating lens and distributes the light in a predetermined pattern; and
an element located in an area proximate the one or more LEDs to minimize an amount of light received from an external source which exits the device.

2. The signal according to claim 1, wherein the distribution optic includes a pattern on at least one of an outside surface and an inside surface to distribute the light.

3. The signal according to claim 1, wherein the LED array is mounted to a substrate and the substrate is mounted to a rear housing wall of the device.

4. The signal according to claim 1, wherein the element comprises at least one retroreflectors.

5. The signal according to claim 4, wherein the one or more retroreflectors is comprised of plastic.

6. The signal according to claim 4, wherein the element comprises a plurality of retroreflectors side-by-side in an array.

7. The signal according to claim 6, wherein the retroreflectors are positioned in an array which is larger than the array of LEDs.

8. The signal according to claim 1, wherein the element comprises:
a hole located proximate to the one or more LEDs; and
one or more reflective elements that receive external light and direct said light into the hole.

9. The signal according to claim 8, wherein the one or more reflective elements are positioned along a radius that circumscribes the hole.

10. The signal according to claim 1, wherein the element comprises:
a hole located proximate to the one or more LEDs; and
a converging element positioned between the lens and the rear housing wall to direct external light from the lens into the hole.

11. The signal according to claim 10, wherein the converging element is one of a biconvex lens, a plano-convex lens, and a positive meniscus lens.

12. The signal according to claim 1, wherein the element is mounted to the rear housing wall located below the one or more LEDs.

13. The signal according to claim 1, wherein the element comprises a black felt.

14. An LED traffic signal, comprising:
a rear housing wall;
an LED array mounted to the rear housing wall;
a lens that receives and collimates the light from the LED array;
a distribution optic that receives light from the lens and distributes the light in a predetermined pattern; and
a converging element that receives external light from the lens and directs it to a light trap within the traffic signal.

15. The traffic signal according to claim 14, wherein the converging element comprises one or more reflectors that surround the light trap.

16. The traffic signal according to claim 15, wherein the light trap is a hole.

17. An LED traffic signal, comprising:
a housing that includes a rear housing wall;
an array of LEDs that is mounted to the rear housing wall;
a lens that receives and collimates the light from the LED array;
a distribution optic that receives light from the lens and distributes the light in a pattern according to a specification; and
a plurality of retroreflectors mounted to the rear housing wall below the LED array to receive external light and minimize sun phantom effect associated with the external light.

18. A light emitting device comprising:
a housing that includes a rear housing wall;
one or more LEDs that emit light, said one or more LEDs mounted in the house;
a device optic mounted to the housing in light receiving relationship to the one or more LEDs for directing LED emitting light to an observer of the light emitting device; and
an optical arrangement mounted in the housing in proximity to the one or more LEDs, the optical arrangement including a light redirecting element whereby light entering the light emitting device from outside the housing is at least partially absorbed and at least partially redirected so not to be on an axis of LED light emitted from the light emitting device.

19. The light emitting device of claim 18 wherein the optical arrangement redirects extraneous light out of the housing through the device optic substantially along the axis said extraneous light entered the light emitting device.

20. The light emitting device of claim 19 wherein the optical arrangement includes a retroreflector.

21. The light emitting device of claim 20 wherein the retroreflector comprises an array of corner cubes.

22. The light emitting device of claim 18 wherein the optical arrangement redirects extraneous light to a light trap.

* * * * *